United States Patent [19]

Quacquarini et al.

[11] Patent Number: 4,476,638

[45] Date of Patent: Oct. 16, 1984

[54] FLEXIBLE WOODEN INSOLE AND UNDERLYING SUPPORT

[76] Inventors: Florindo Quacquarini; Florindo Severini, both of Via Circonvallazione, 103, Monte San Giusto (MC), Italy

[21] Appl. No.: 474,327

[22] Filed: Mar. 11, 1983

[30] Foreign Application Priority Data

Mar. 15, 1982 [IT] Italy ..... 19405/82[U]

[51] Int. Cl.[3] ..... A43B 1/06; A43B 13/38; A43B 3/12

[52] U.S. Cl. ..... 36/86; 36/43; 36/44; 36/11.5; 36/31; 36/103

[58] Field of Search ..... 36/44, 31, 103, 86, 36/11.5, 43

[56] References Cited

U.S. PATENT DOCUMENTS

| | | | |
|---|---|---|---|
| 1,964,705 | 6/1934 | Pellkofer | 36/11.5 |
| 2,072,785 | 3/1937 | Wulff | 36/11.5 |
| 2,478,664 | 8/1949 | Morrow et al. | 36/31 |
| 4,059,910 | 11/1977 | Bryden et al. | 36/103 |

FOREIGN PATENT DOCUMENTS

| | | | |
|---|---|---|---|
| 511592 | 9/1920 | France | 36/31 |
| 757236 | 12/1933 | France | 36/44 |
| 346356 | 2/1937 | Italy | 36/44 |
| 46172 | 2/1909 | Switzerland | 36/44 |

*Primary Examiner*—Werner H. Schroeder
*Assistant Examiner*—Steven N. Meyers
*Attorney, Agent, or Firm*—Leonard Bloom

[57] ABSTRACT

A flexible shoe insole consisting of strips of narrow bands of wood spaced from each other and fixed to a pliable underlying support. The strips are oriented with the length of the strip being transverse to the longitudinal axis of the foot and the operative connection to the pliable underlying substrate allows flexure of the insole for beneficial support while the choice of materials associated with the insole allows aspiration of the foot as well as thermal protection.

8 Claims, 11 Drawing Figures

TAV.I-2

TAV.II-2

FLEXIBLE WOODEN INSOLE AND UNDERLYING SUPPORT

BACKGROUND OF THE INVENTION

The following invention relates generally to insoles suitably fabricated so as to be flexible and including a plurality of wooden strips disposed on a flexible bottom layer, the strips of wood having the grained disposed transverse to the longitudinal axis of the foot and dimensioned so as to encourage flexibility of the insole in a predetermined manner.

The inability of insoles associated with articles of footwear to aspirate and/or provide beneficial thermal properties has been a longstanding problem to which the instant application directs itself. The inability to aspirate includes concomitant disadvantages such as unhygienic in which various types of fungus can thrive, remain within the insole and be reactivated given the heat migration associated with a foot disposed within an associated shoe.

The problems associated with transfer of heat from the foot to the associated environment or vice versa demonstrates another longstanding problem in footwear construction to which the instant application addresses itself, and thus answers to long felt yet heretofore unsatisfied needs which have been provided by the instant application.

OBJECTS AND SUMMARY OF THE INVENTION

Accordingly, this invention has as an objective the provision of a new and novel insole for an article of footwear.

A futher object of this invention contemplates providing a device as characterized above which exhibits improved aspiration irrespective of climatic conditions.

A futher object of this invention contemplates providing a device as characterized above which provides improved thermal characteristics over known prior art devices.

A further object of this invention contemplates providing a device as characterized above in which the support for the associated foot is improved by the flexible nature of the insole.

A futher object of this invention contemplates providing a device as characterized above in which the insole is formed from a plurality of elements interrelated and contoured such that the insole does not hurt the foot in any way.

These and other objects will be made manifest when considering the following detailed specification whe taken in conjunction with the appended drawing figures wherein there has been provided an instrumentality adapted to serve as an insole for articles of footwear such as shoes, boots, or the like in which a topmost portion of the insole is formed from a plurality of wooden strips having a grain and length associated therewith which is transverse to the longitudinal axis of the foot, the plural strips having appropriate dimensioning and contouring to provide a comfortable bearing support surface for the associated foot, and an underlying instrumentality of a flexible nature upon which the slats of wood are to be affixed. In this manner, flexure of the insole can occur corresponding to demands for flexibility placed on it by the foot and no binding or pinching can occur while concomitantly the nature of the wood promotes and encourages improved ventilation of the foot for beneficial aspiration thereof and includes improved thermal characteristics associated with the insole in the foot's relationship to the ambient environment so that temperature differentials can be accommodated and accounted for by the nature of the insole.

BRIEF DESCRIPTION OF THE PREFERRED EMBODIMENT

Figure 1:
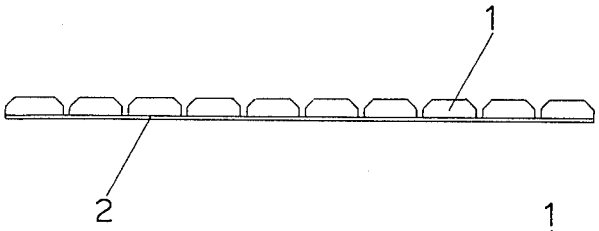
FIG. 1 is a side view of the apparatus according to the instant invention.
Figure 2:
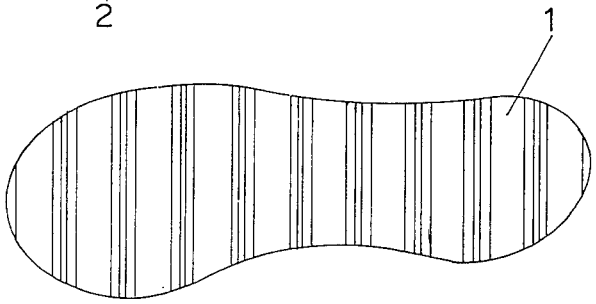
FIG. 2 is a top plan view thereof.
Figure 3:
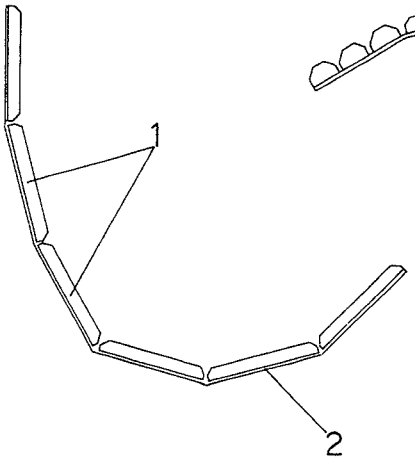
FIG. 3 shows one flexure pattern of the apparatus according to the instant invention.
Figure 4:
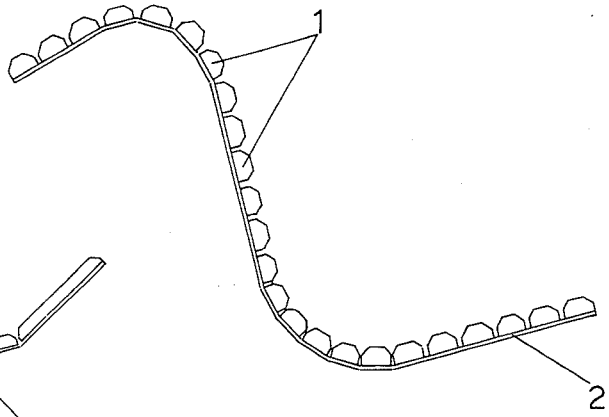
FIG. 4 shows a second mode of flexure.
Figure 5:
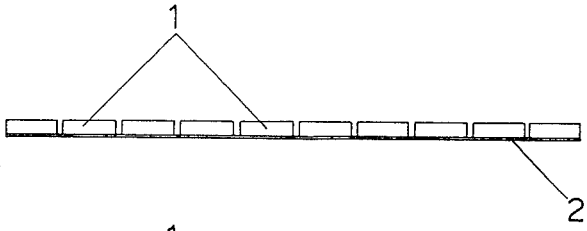
FIG. 5 shows a second profile possible according to the instant application.
Figure 6:
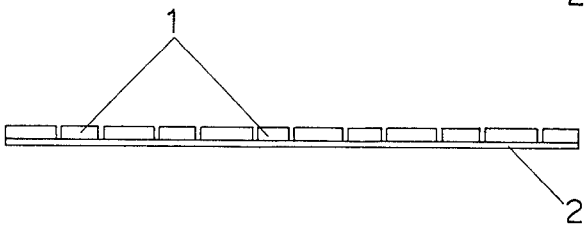
FIG. 6 shows a further profile.
Figure 7:
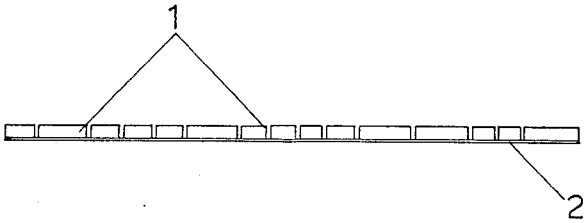
FIG. 7 shows a further profile.

Referring now to the drawing figures, wherein like reference numerals refer to like parts throughout the various drawing figures, reference numeral 1 is directed to the plurality of slats adapted to be disposed on an underlying substrate 2 formed of flexible material.

Figure 8:
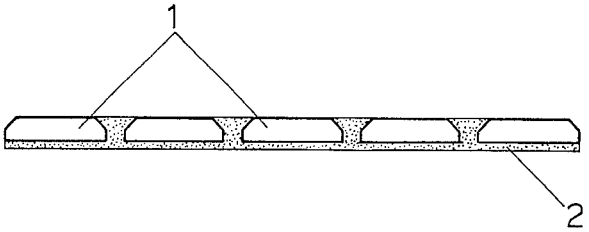
FIG. 8 shows a further profile having portions of the underlying substrate extending between adjacent slats.
Figure 9:
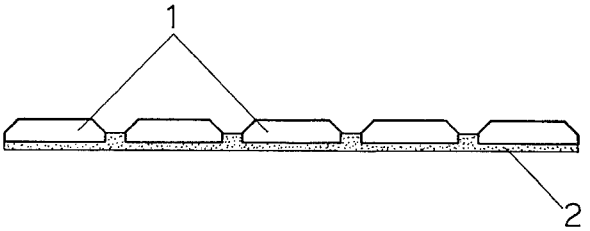
FIG. 9 is similar to FIG. 8 showing a modified version thereof.
Figure 10:
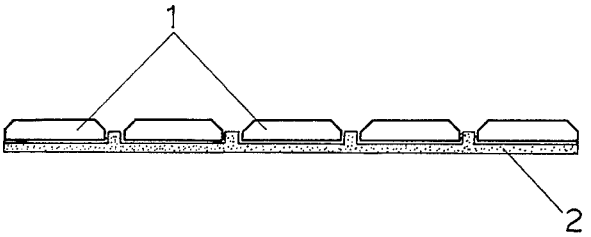
FIG. 10 is a further modified version of that which is shown in FIGS. 8 and 9.

More particularly, the insole has a lower flexible substrate 2 formed from any of a plurality of materials characterized in that the strata be pliable and capable of having affixed on a top surface thereof a plurality of wooden strips. FIGS. 8 through 10 reflect variations on the flexible, pliable support which will be delineated hereinafter.

The plural wooden strips or bands 1 are placed in side by side parallel relation one relative to the another on top of the pliable substrate 2, and are firmly attached thereto. The bands of wood are oriented such that their length is placed transverse to the longitudinal axis of the foot and are separated one from another by a space the magnitude of which is such that the strips when underlying the foot does not hurt the foot in any way as by pinching or the like. To this end, comfort is provided the wearer of the insole by having the width of the strips vary as they extend along the longitudinal aspect of the foot so that some areas are relatively more flexible than others if desired. In addition, the top surface edges of the wooden slats can be chamferred, bevelled, truncated or provided with a constant radius filet or altered in another manner so that the space between adjacent slats will not provide areas which can bind or pinch the plantar surface of a person's foot. It is of particular importance that the strips or narrow bands of wood be fashioned such that the grain of the wood be disposed transverse the longitudinal axis of the foot so that comfort has been maximized.

As shown in the drawings, it should be clear that adjacent strips or bands of wood are all connected to the pliable substrate 2, but in their unflexed condition the adjacent strips are not physically tangent to each other in a preferred form of the invention. More particularly, FIGS. 8 through 10 show an embodiment in which the underlying pliable support substate 2 is formed a flexible material having portions which extend at least a portion of the way up between adjacent bands or slats of wood. As shown in FIG. 10 for example, the upwardly extending members are still spaced from and provided with a gap between adjacent slats, while in the FIG. 9 configuration the upwardly extending portions are in tangential registry with a non-bevelled portion of the associated wood strip. FIG. 8 reflects an embodiment in which the flexible substrate extends upwardly and comes in tangential contact with the bevelled surfaces of the slats and terminate at the same horizontal elevation as the top face of the wood slats.

Figure 11:
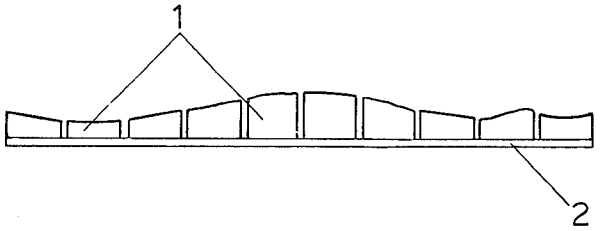
FIG. 11 shows a contour of a side profile of an associated insole.

FIG. 11 reflects an embodiment in which a plurality of the wooden slats have different heights and contours so as to accommodate the anatomical configuration of a person's foot.

Thus, in view of the foregoing it is clear that there has been provided an insole to be removeable or fixedly placed within a shoe or the like which is formed from a plurality of wood slats disposed with its grain and length transverse to the longitudinal extent of the foot, plural adjacent slats being relatively spaced one to the other and all of which are supported on and affixed to a pliant substrate so the slats are adapted to articulate one relative to the other about the length of adjacent wooden slats and appropriate ventilation has been provided to assure that the insole formed according to the instant invention is hygienic and allows foot aspiration to occur, yet the thermal conductivity of the wood is such that temperature differentials between the ambient conditions and the skin temperature of the foot is not compromised by the unwanted effects of heat sinks due to heat transfer, since wood is an excellent thermal insulator.

Having thus described the preferred embodiment of the invention, it should be understood that numerous structural modifications and adaptations may be resorted to without departing from the spirit of the invention.

We claim:

1. A flexible insole to be placed within a shoe, boot or the like comprising in combination:

a flexible substrate dimensioned to be received within the shoe, a plurality of wooden slats having bottom faces fastened to an upper surface of said substrate, each slat oriented parallel to one another and transverse to the longitudinal axis of the shoe, and each slat spaced from an adjacent slat, whereby upper faces of said slats come in direct contact with the bottom surface of a person's foot wearing the shoe and said slats can articulate one relative to another to accommodate foot flexure while allowing proper thermal aspiration of the foot, wherein said spaces between adajcent slats is constant for all slats, wherein top longitudinal edges of said wooden slats are provided with a contoured surface whereby articulation of adjacent slats precludes pinching of the skin of the foot supported thereon, and wherein said flexible substrates includes portions thereof interposed between adjacent side faces of said wooden slats.

2. The device of claim 1, wherein said contoured surface is a bevel.

3. The device of claim 1, wherein said contoured surface is rounded.

4. The device of claim 1, wherein said contoured surface is angular.

5. The device of claim 1, wherein said interposed portions extend up to the top planar surface of said wooden slats.

6. The device of claim 1, wherein spaces are provided on each side of said interposed portions.

7. The device of claim 1, wherein the height of each slat varies in accordance with the anatomical configuration of a person's foot.

8. The device of claim 7, wherein the width of adjacent slats varies in accordance with variations in flexure of the foot.

* * * * *